US007789704B2

(12) United States Patent
Ho

(10) Patent No.: US 7,789,704 B2
(45) Date of Patent: Sep. 7, 2010

(54) CONNECTOR WITH CONTACTS HAVING PORTIONS SHAPED AND ARRANGED FOR EASE OF SOLDERING

(75) Inventor: Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/314,284

(22) Filed: Dec. 8, 2008

(65) Prior Publication Data

US 2010/0144210 A1 Jun. 10, 2010

(51) Int. Cl.
*H01R 13/58* (2006.01)

(52) U.S. Cl. ..... 439/606

(58) Field of Classification Search ..... 439/606, 439/604, 736, 677, 668, 669, 76.1
See application file for complete search history.

(56) References Cited

U.S. PATENT DOCUMENTS

| | | | | | |
|---|---|---|---|---|---|
| 3,031,639 | A * | 4/1962 | Majewski | 439/740 |
| 4,008,941 | A * | 2/1977 | Smith | 439/358 |
| 4,986,764 | A * | 1/1991 | Eaby et al. | 439/275 |
| 5,253,316 | A * | 10/1993 | Shibutani et al. | 385/78 |
| 5,454,734 | A * | 10/1995 | Eggert et al. | 439/578 |
| 5,474,459 | A * | 12/1995 | Su | 439/106 |
| 5,676,565 | A * | 10/1997 | Vagnoni | 439/580 |
| 5,938,478 | A * | 8/1999 | Werner | 439/668 |
| 6,250,817 | B1 * | 6/2001 | Lampert et al. | 385/56 |
| 6,482,036 | B1 * | 11/2002 | Broussard | 439/606 |
| 6,585,536 | B1 * | 7/2003 | Wu | 439/358 |
| 6,585,537 | B1 * | 7/2003 | Lee | 439/358 |
| 6,616,487 | B1 * | 9/2003 | Lai | 439/668 |
| D482,657 | S * | 11/2003 | Lai | D13/146 |
| 6,786,778 | B2 * | 9/2004 | Lai | 439/701 |
| 6,808,410 | B1 * | 10/2004 | Lee | 439/484 |
| 6,843,683 | B2 * | 1/2005 | Cheng | 439/606 |
| 6,855,006 | B2 * | 2/2005 | Brooks et al. | 439/606 |
| 6,910,920 | B2 * | 6/2005 | Su | 439/606 |
| 6,981,896 | B2 * | 1/2006 | Su | 439/606 |
| 6,991,497 | B1 * | 1/2006 | Lin | 439/668 |
| 7,070,441 | B1 * | 7/2006 | Gregory et al. | 439/404 |
| D525,942 | S * | 8/2006 | Cheng et al. | D13/147 |
| D529,868 | S * | 10/2006 | Shimizu | D13/147 |
| 7,121,899 | B2 * | 10/2006 | Homann et al. | 439/680 |
| D531,619 | S * | 11/2006 | Chau | D14/217 |
| D531,991 | S * | 11/2006 | Chau | D14/247 |
| D550,159 | S * | 9/2007 | Kawanobe | D13/146 |
| 7,300,316 | B1 * | 11/2007 | Chen et al. | 439/677 |
| D560,166 | S * | 1/2008 | Andre et al. | D13/133 |

(Continued)

*Primary Examiner*—T C Patel
*Assistant Examiner*—Vladimir Imas
(74) *Attorney, Agent, or Firm*—Rosenberg, Klein & Lee

(57) ABSTRACT

A connector has a dielectric housing having a base. The base has a protruding platform at a front surface thereof. A peripheral dimension of the protruding platform is smaller than that of the base. At least one connecting unit is mounted to the dielectric housing with contacts thereof extending out from both a front surface of the protruding platform and a rear surface of the base. A plastic shield is integrally molded with the dielectric housing and encloses a periphery of the dielectric housing. The plastic shield has a basic body. The basic body has a first cavity at a front thereof for receiving the protruding platform and a second cavity disposed inside the basic body and communicating with the first cavity for accommodating the base.

6 Claims, 5 Drawing Sheets

U.S. PATENT DOCUMENTS 7,314,391 B1 * 1/2008 Yoshida et al. ..... 439/668
7,329,155 B2 * 2/2008 Peters et al. ..... 439/680
7,371,104 B2 * 5/2008 Wu ..... 439/358
7,500,884 B2 * 3/2009 Peters et al. ..... 439/680
7,618,298 B2 * 11/2009 Rahman et al. ..... 439/736
2003/0129875 A1 * 7/2003 Ho ..... 439/606
2004/0097132 A1 * 5/2004 Cheng ..... 439/606
2005/0020133 A1 * 1/2005 Homann et al. ..... 439/606

* cited by examiner

CONNECTOR WITH CONTACTS HAVING PORTIONS SHAPED AND ARRANGED FOR EASE OF SOLDERING

BACKGROUND OF THE INVENTION

1. Field of the Invention

The present invention generally relates to a connector, and more particularly to a connector adapted for electrically connecting with a butting connector.

2. The Related Art

A conventional connector includes a substantially rectangular housing, a first contacting element, a second contacting element and a plastic shield. The first contacting element and the second contacting element are both mounted to the housing. In assembly, the plastic shield is integrally molded with the housing, surrounding a periphery of the housing. Thus, when inserting or pulling the connector into or out of a butting connector is required, a user can hold the plastic shield of the connector to achieve operation of insertion or extraction. So it is important to guarantee the steady engagement between the housing and the plastic shield. However, since the housing is of a rectangular shape, the plastic shield integrally molded with the housing, encircling the periphery of the housing, is easy to be disengaged from the housing, which may affect normal operation so as to bring inconvenience to the user.

SUMMARY OF THE INVENTION

An object of the present invention is to provide a connector which has a structure making a plastic shield be engaged with a dielectric housing firmly. The connector has a dielectric housing having a base. The base has a protruding platform at a front surface thereof. A peripheral dimension of the protruding platform is smaller than that of the base. At least one connecting unit is mounted to the dielectric housing with contacts thereof extending out from both a front surface of the protruding platform and a rear surface of the base. A plastic shield is integrally molded with the dielectric housing and encloses a periphery of the dielectric housing. The plastic shield has a basic body. The basic body has a first cavity at a front thereof for receiving the protruding platform and a second cavity disposed inside the basic body and communicating with the first cavity for accommodating the base.

As described above, since the peripheral dimension of the base is larger than that of protruding platform, a portion of the base exceeding the protruding platform can block the plastic shield for preventing the plastic shield from disengaging from the dielectric housing, when the connector is inserted into and pulled out of the butting connector.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
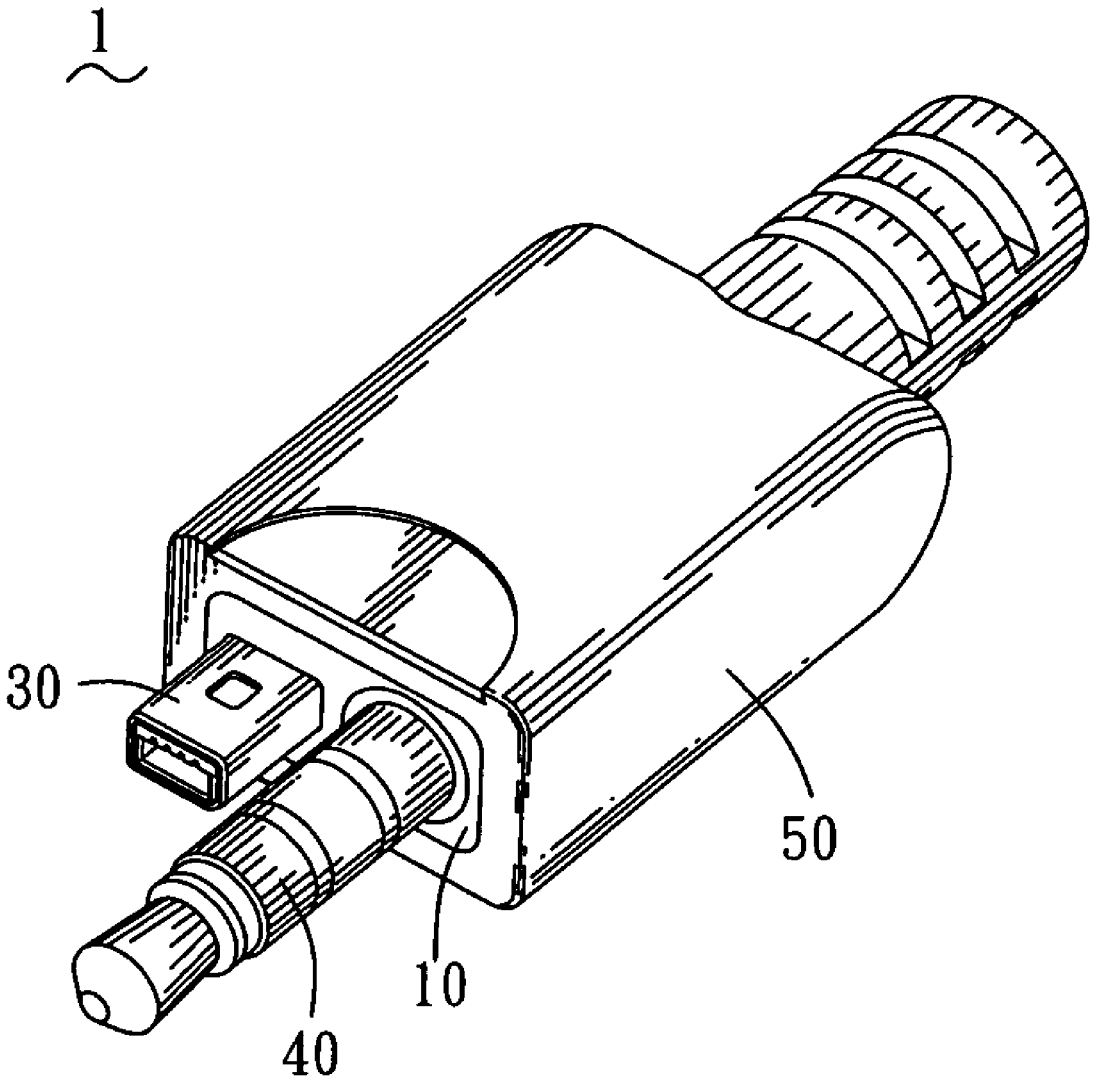
FIG. 1 is a perspective view of a connector of an embodiment in accordance with the present invention.
Figure 2:
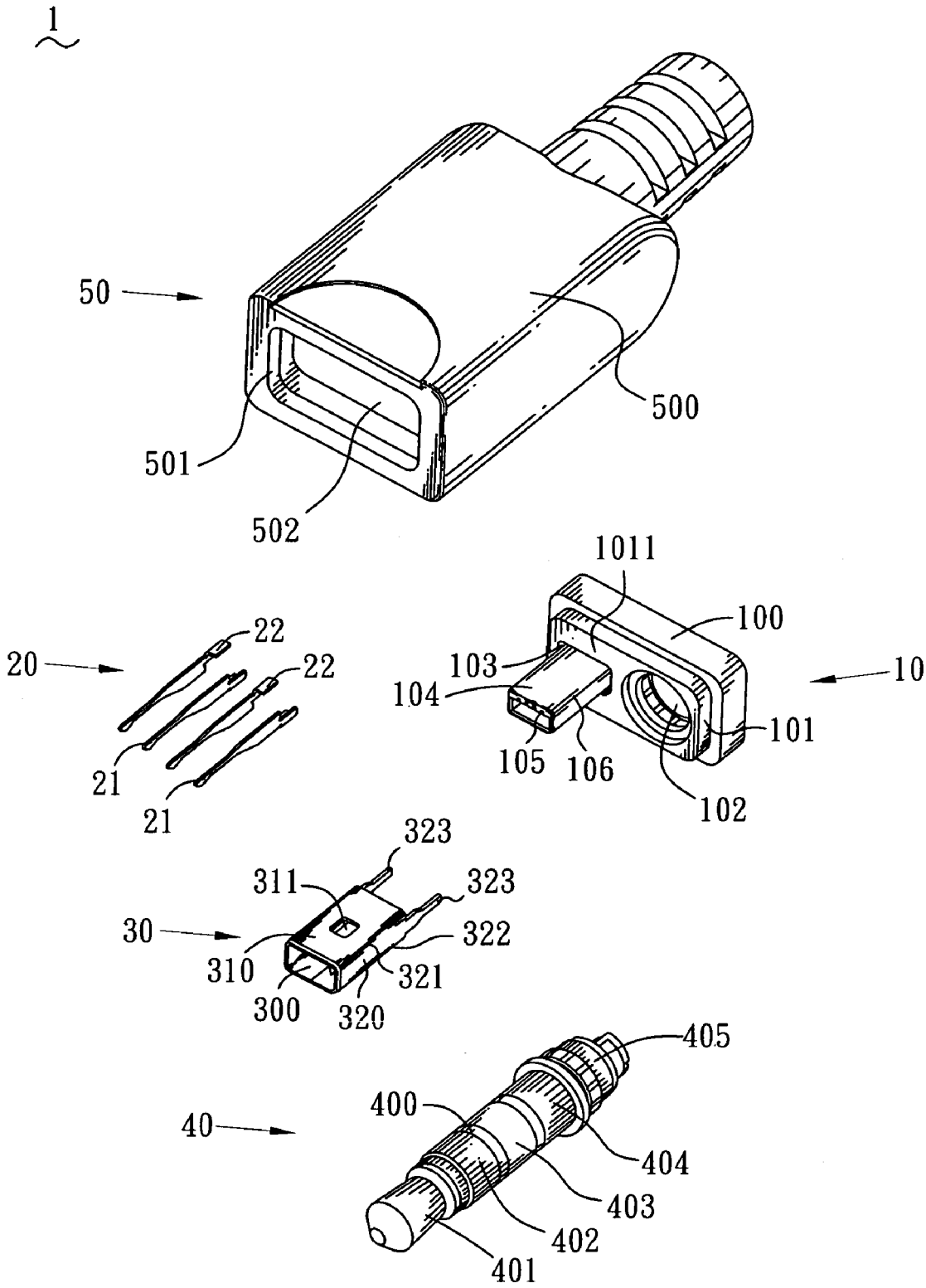
FIG. 2 is a plan perspective view of the connector shown in FIG. 1.
Figure 3:
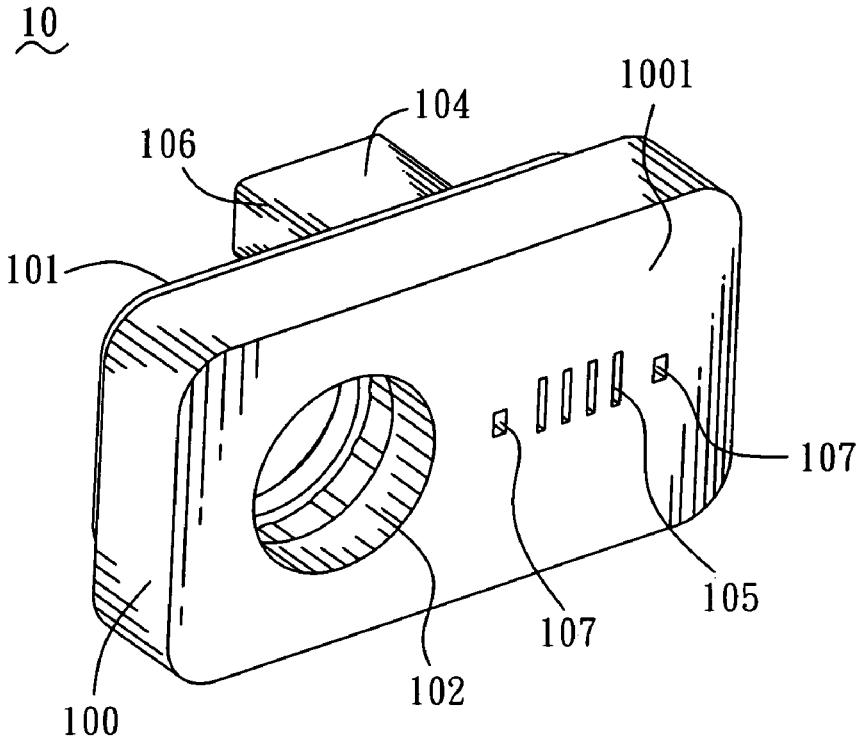
FIG. 3 is a perspective view of a dielectric housing of the connector shown in FIG. 2 seen from another angle.
Figure 4:
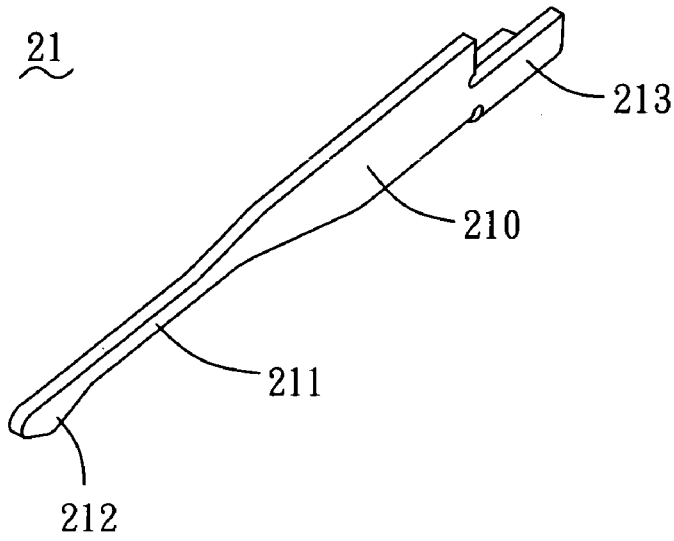
FIG. 4 is a perspective view of a first contact of the connector shown in FIG. 2.
Figure 5:
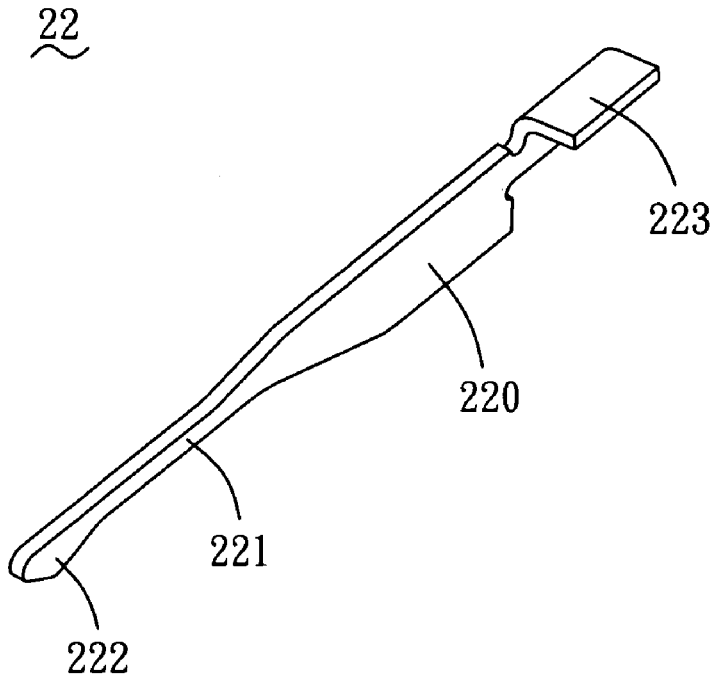
FIG. 5 is a perspective view of a second contact of the connector shown in FIG. 2.

With reference to FIGS. 1-3, a connector 1 of an embodiment according to the present invention is shown. The connector 1 includes a dielectric housing 10, a first contact group 20, an audio plug 40 and a plastic shield 50.

The dielectric housing 10 has a substantially rectangular base 100. The base 100 is extended frontward from a front surface thereof to form a protruding platform 101, with a front surface 1011 defined. The protruding platform 101 is also a substantially oblong shape, a peripheral dimension of which is smaller than that of the base 100. One side of the protruding platform 101 has a receiving hole 102. The receiving hole 102 is a round shape and passes through the protruding platform 101 and the base 100. The other side of the protruding platform 101 defines an inserting recess 103, abreast with the receiving hole 102. A bottom surface of the inserting recess 103 has a portion extended frontward to form an inserting portion 104 of rectangular shape. The inserting portion 104 has a plurality of grooves 105 extending from a front end thereof to a rear surface 1001 of the base 100. Two upper corners of the inserting portion 104 are formed to show an arc shape, with a predetermined radius thereof, named engaging portions 106. The rear surface 1001 of the base 100 further has two apertures 107 disposed in alignment with the grooves 105 (seen from a rear view) and communicating with the inserting recess 103.

Please refer to FIGS. 2, 4, 5 and 7, the first contact group 20 arranged in the grooves 105 of the dielectric housing 10 include two first contacts 21 and two second contacts 22. The first contacts 21 and the second contacts 22 are arranged at intervals.

The first contact 21 has a first holding portion 210 of flat-board shape. A front end of the first holding portion 210 is extended frontward to form a first connecting portion 211. The first connecting portion, 211 protrudes downwardly from a bottom side of a free end thereof to form a first contacting portion 212. A first soldering portion 213 is extended rearward from a lower portion of a rear end of the first holding portion 210, with a bottom side thereof bent perpendicularly to show an inverted-L shape relative to the first contacting portion 212. The second contact 22 substantially similar to the first contact 21 also has a second holding portion 220, a second connecting portion 221 with a second contacting portion 222 disposed at a distal thereof, and a second soldering portion 223. But, the difference between the first contact 21 and the second contact 22 is that the second soldering portion 223 is extended rearward from an upper portion of a rear end of the second holding portion 220, with a top side bent perpendicularly to show an L shape relative to the second contacting portion 222. The first and second holding portions 210, 220 and the first and second connecting portions 211, 221 are respectively received in the corresponding grooves 105. The first soldering portion 213 and the second soldering portion 223 are disposed out of the rear surface 1001 of the base 100 to form cooperatively a substantially rectangular frame shape for convenient soldering.

Figure 6:
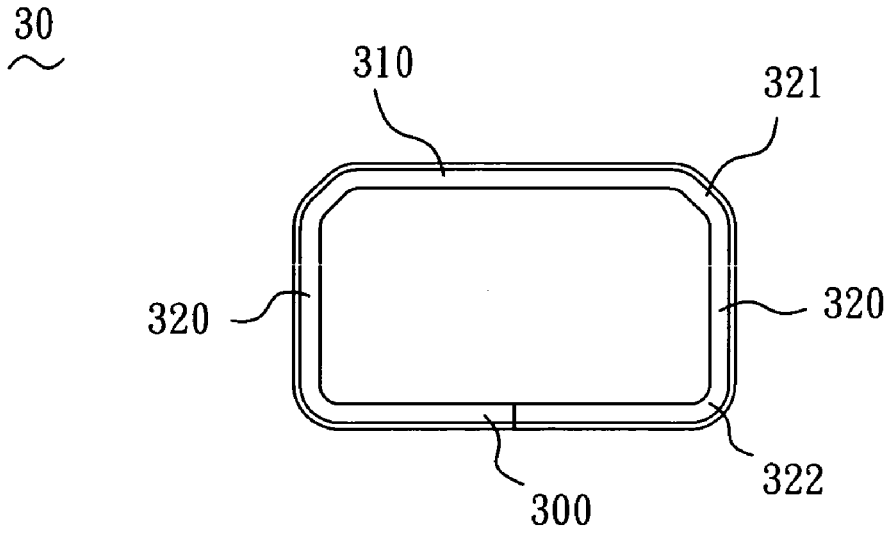
FIG. 6 is a view of a shell of the connector shown in FIG. 2 seen from a front thereof.
Figure 7:
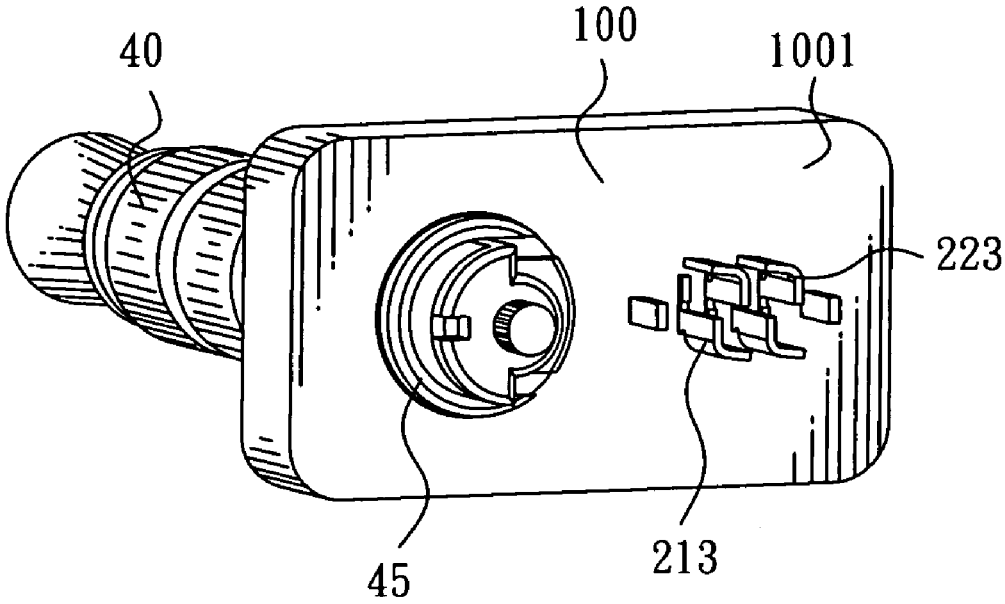
FIG. 7 is a perspective view of the connector shown in FIG. 1 seen from another angle, wherein a plastic shield is removed.

Please refer to FIG. 2 and FIG. 6, the connector 1 further has a shell 30. The shell 30, which may be made of metal sheet, shows a rectangular frame shape and is coupled with the inserting portion 104 of the dielectric housing 10. Herein, the shell 30, the first contact group 20 and the inserting portion 104 form cooperatively a connector component. The shell 30 defines a bottom board 300, a top board 310 opposite to the bottom board 300, and two lateral boards 320 respectively connected with the bottom board 300 and the top board 310. The top board 310 has an opening 311 at a middle thereof to mate with a portion of a butting connector (not shown) for enhancing connection stability between the connector 1 and the butting connector. Each of the lateral boards 320 extends rearward from a portion of a rear side thereof to form a grounding piece 323. The grounding piece 323 projects the rear surface 1001 of the base 100 from the corresponding aperture 107 for being grounded. A junction between the lateral board 320 and the bottom board 300 is defined a bending portion 322 of arc shape, and a junction between the lateral board 320 and the top board 310 is defined a fool-proof portion 321 corresponding to the engaging portion 106 of the dielectric housing 10. The fool-proof portion 321 of arc shape has a radius larger than the radius of the bending portion 322 for preventing improper insertion, when the shell 30 is coupled with the inserting portion 104 and the connector 1 is engaged with the butting connector. Herein, there are two fool-proof portions 321 formed on the shell 30 and contiguous to each other. It should be noted that the number and position of the fool-proof portions can be changed for meeting different demands and should not be limited.

Referring to FIG. 2, the audio plug 40 placed in the receiving hole 102 of the dielectric housing 10 has a substantially columnar main body 400 and a second contact group. A rear end of the main body 400 defines a fixing portion 405 received in the receiving hole 102. The second contact group includes a first audio contact 401, a second audio contact 402, a third audio contact 403 and a fourth audio contact 404 which are all arranged in the main body 400 along an axial direction of the main body 400 from front to rear in turn, and spaced away from each other. Meanwhile, the first audio contact 401, the second audio contact 402, the third audio contact 403 and the fourth audio contact 404 all extend out of a rear end of the fixing portion 405 for being connected with corresponding circuits (not shown). In this embodiment, the audio plug 40 and the connector component are all adapted, as a connecting unit, for electrically connecting with the butting connector. Also, the audio plug 40 and the connector component can be separately mounted in the dielectric housing 10, as the connecting unit.

Figure 8:
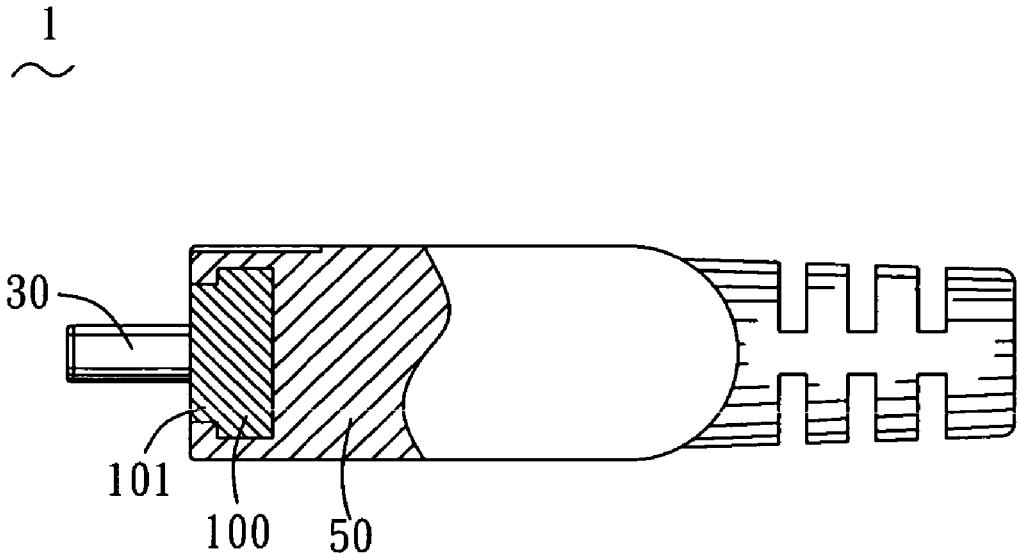
FIG. 8 is a partial cross-sectional view of the connector shown in FIG. 1.

Please refer to FIGS. 1, 2 and 8, the plastic shield 50 is integrally molded with the dielectric housing 10, enclosing a periphery of the dielectric housing 10. The plastic shield 50 has a substantially rectangular basic body 500. A front of the basic body 500 has a first cavity 501 of rectangular shape. A second cavity 502, which is also a rectangular shape, is disposed inside the basic body 500 and communicates with the first cavity 501. Moreover, the second cavity 502 has a larger dimension in cross-section parallel to a front surface of the basic body 500 than that of the first cavity 501. When the dielectric housing 10 is integrally engaged with the plastic shield 50, the base 100 and the protruding platform 101 are respectively received in the second cavity 502 and the first cavity 501, with the front surface 1011 of the protruding platform 101 flush with the front surface of the basic body 500.

As described above, since the peripheral dimension of the base 100 is larger than that of protruding platform 101, a portion of the base 100 exceeding the protruding platform 101 can block the plastic shield 50 for preventing the plastic shield 50 from disengaging from the dielectric housing 10, when the connector 1 is inserted into and pulled out of the butting connector.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector comprising:

a dielectric housing having a base, the base having a protruding platform at a front surface thereof, a peripheral dimension of the protruding platform being smaller than that of the base;

at least one connecting unit mounted to the dielectric housing with contacts thereof extending out from both a front surface of the protruding platform and a rear surface of the base, the contacts including a plurality of first contacts and a plurality of second contacts separated by the first contacts, each first contact having a first soldering portion of L-shape, and each second contact having a second soldering portion of inverted-L shape, which are both arranged out of the base to cooperatively form a substantially rectangular frame shape for convenient soldering; and a plastic shield integrally molded with the dielectric housing and enclosing a periphery of the dielectric housing, the plastic shield having a basic body, the basic body having a first cavity at a front thereof for receiving the protruding platform and a second cavity disposed inside the basic body and communicating with the first cavity for accommodating the base.

2. The connector as claimed in claim 1, wherein the at least one connecting unit comprises a connector component which includes a rectangular inserting portion located in an inserting recess defined in the protruding platform and extending out from the front surface of the protruding platform for receiving corresponding contacts therein.

3. The connector as claimed in claim 2, further comprising a shell, the shell coupled with the inserting portion having at least one corner formed with an arc-shaped fool-proof portion of which has a radius larger than that of other corners of the shell corresponding to at least one engaging portion of arc shape defined on the inserting portion for preventing improper insertion.

4. A connector comprising:

a dielectric housing having a base, the base having a protruding platform at a front surface thereof, a peripheral dimension of the protruding platform being smaller than that of the base;

at least one connecting unit mounted to the dielectric housing with contacts thereof extending out from both a front surface of the protruding platform and a rear surface of the base, the at least one connecting unit comprising a connector component which includes a rectangular inserting portion located in an inserting recess defined in the protruding platform and extending out from the front surface of the protruding platform for receiving corresponding contacts therein;

a plastic shield integrally molded with the dielectric housing and enclosing a periphery of the dielectric housing, the plastic shield having a basic body, the basic body having a first cavity at a front thereof for receiving the protruding platform and a second cavity disposed inside the basic body and communicating with the first cavity for accommodating the base; and a shell coupled with the inserting portion and having at least one corner formed with an arc-shaped fool-proof portion of a radius larger than that of other corners of the shell corresponding to at least one engaging portion of arc shape defined on the inserting portion for preventing improper insertion, the shell having two opposite lateral boards, each of the lateral boards extending rearwardly to form a ground piece passing through the inserting recess and projecting out of the base through an aperture of the base communicating with the inserting recess for being grounded.

5. The connector as claimed in claim 4, wherein the at least one connecting unit further comprises an audio plug mounted to a receiving hole defined in the protruding platform and the base and extending out from the front surface of the protruding platform.

6. The connector as claimed in claim 1, wherein the at least one connecting unit comprises an audio plug mounted to a receiving hole defined in the protruding platform and the base and extending out from the front surface of the protruding platform.

* * * * *